United States Patent [19]

Sakuma

[11] Patent Number: 5,041,363

[45] Date of Patent: Aug. 20, 1991

[54] METHOD OF PROCESSING LIGHT-SENSITIVE SILVER HALIDE PHOTOGRAPHIC MATERIAL

[75] Inventor: Haruhiko Sakuma, Hino, Japan

[73] Assignee: Konica Corporation, Tokyo, Japan

[21] Appl. No.: 521,313

[22] Filed: May 9, 1990

[30] Foreign Application Priority Data

May 19, 1989 [JP] Japan ..... 64-126167

[51] Int. Cl.[5] ..... G03C 5/26

[52] U.S. Cl. ..... 430/435; 430/438; 430/439; 430/440; 430/442; 430/446; 430/481; 430/966

[58] Field of Search ..... 430/435, 438, 439, 440, 430/442, 446, 481, 966

[56] References Cited

U.S. PATENT DOCUMENTS

| | | | |
|---|---|---|---|
| 4,269,929 | 5/1981 | Nothnagle | 430/438 |
| 4,323,642 | 4/1982 | Levinson | 430/438 |
| 4,391,900 | 7/1983 | Toyoda et al. | 430/438 |
| 4,693,956 | 9/1987 | Marchesano | 430/438 |
| 4,810,622 | 3/1989 | Yamada et al. | 430/438 |
| 4,863,830 | 9/1989 | Okutsu et al. | 430/438 |

*Primary Examiner*—Hoa Van Le

*Attorney, Agent, or Firm*—Frishauf, Holtz, Goodman & Woodward

[57] ABSTRACT

A method of processing a silver halide photographic material with a compact and high speed automatic processor is disclosed. The developing solution contains hydroquinone, 1-phenyl-4-methyl-3-pyrazolidone, and 1-phenyl-4,4-dimethyl-3-pyrazolidone or 1-phenyl-4-methyl-4-hydroxy-methyl-3-pyrazolidone. The method is suitable for an X-ray photographic material.

18 Claims, 2 Drawing Sheets

METHOD OF PROCESSING LIGHT-SENSITIVE SILVER HALIDE PHOTOGRAPHIC MATERIAL

FIELD OF THE INVENTION

The present invention relates to a method of processing light-sensitive silver halide photographic material. The present invention can be utilized particularly as a method for ultra-rapid processing carried out using an automatic processor.

BACKGROUND OF THE INVENTION

In regard to light-sensitive silver halide photographic materials, it is sought to achieve more rapid processing. For example, in the field of X-ray light-sensitive photographic materials, it is often desired to obtain photographic images as soon as possible, as in photographs amidst an operation.

Various techniques for rapid processing have been proposed, but image quality may be often affected with an increase in the rapidness of processing. In particular, rapid processing often brings about development non-uniformity, and it is desired to prevent such development non-uniformity as far as possible. Particularly when an accurate image must be obtained, e.g., when it is intended to obtain a precise X-ray photographic image for medical purposes, the processing is required to give no development non-uniformity.

For example, when, in processing carried out using an automatic processor, a line length (m) through which a light-sensitive material firstly comes into contact with the surface of a developing solution and thereafter comes into contact with the surface of a fixing solution is assumed as l and a time (second) required for the light-sensitive material to pass the above l is assumed as T, there is an ultra-rapid processing technique in which the processing is carried out under a high-speed condition of:

$$l^{0.75} \times T < 10.5.$$

However, nothing has been known as to an instance in which l is not more than 0.6 m. Studies made by the present inventors have confirmed that the development non-uniformity particularly tends to occur when it is attempted to apply the above condition to the instance of $l<0.6$. In the processing in which a large-scale automatic processor with line lengths of $l<0.6$ and also $l>0.7$, the development non-uniformity may occur with difficulty. When however, a medium- or small-scale automatic processor with a line with of $l<0.6$ as in the above, there is a great problem of such development non-uniformity. This problem is an obstacle to reducing the scale of an automatic processor.

SUMMARY OF THE INVENTION

An object of the present invention is to provide a method of processing a light-sensitive silver halide photographic material, that is feasible for rapid processing, may cause less development non-uniformity even when rapid processing is carried out, and can exhibit such effect even when the above defined l is not more than 0.6 m, and hence can also reduce the scale of an automatic processor.

In the method of the present invention, a light-sensitive silver halide photographic material having been imagewise exposed to light is processed on an automatic processor falling under the following Expression I, using a developing solution that contains hydroquinone, 1-phenyl-4-methyl-3-pyrazolidone, and 1-phenyl-4,4-dimethyl-3-pyrazolidone or 1-phenyl-4-methyl-4-hydroxymethyl-3-pyrazolidone. Expression I:

$$l^{0.75} \times T < 10.5$$

wherein;

l: a line length (m) through which a light-sensitive material firstly comes into contact with the surface of a developing solution and thereafter comes into contact with the surface of a fixing solution, which is $l<0.6$; and T: a time (second) required for the light-sensitive material to pass said l.

The present invention can achieve rapid development processing and also makes it possible to make compact an automatic processor, and hence makes it possible to result in an automatic processor small in size and large in processing capacity. In addition to such feasibleness for rapid processing, the present invention can also materialize processing that may not cause any development non-uniformity. Prevention of such development non-uniformity is presumably attributable to the action of 1-phenyl-4-methyl-3-pyrazolidone, and 1-phenyl-4,4-dimethyl-3-pyrazolidone or 1-phenyl-4-methyl-4-hydroxymethyl-3-pyrazolidone. It was difficult even for the present inventors to conjecture this action.

DETAILED DESCRIPTION OF THE INVENTION

Figure 1:
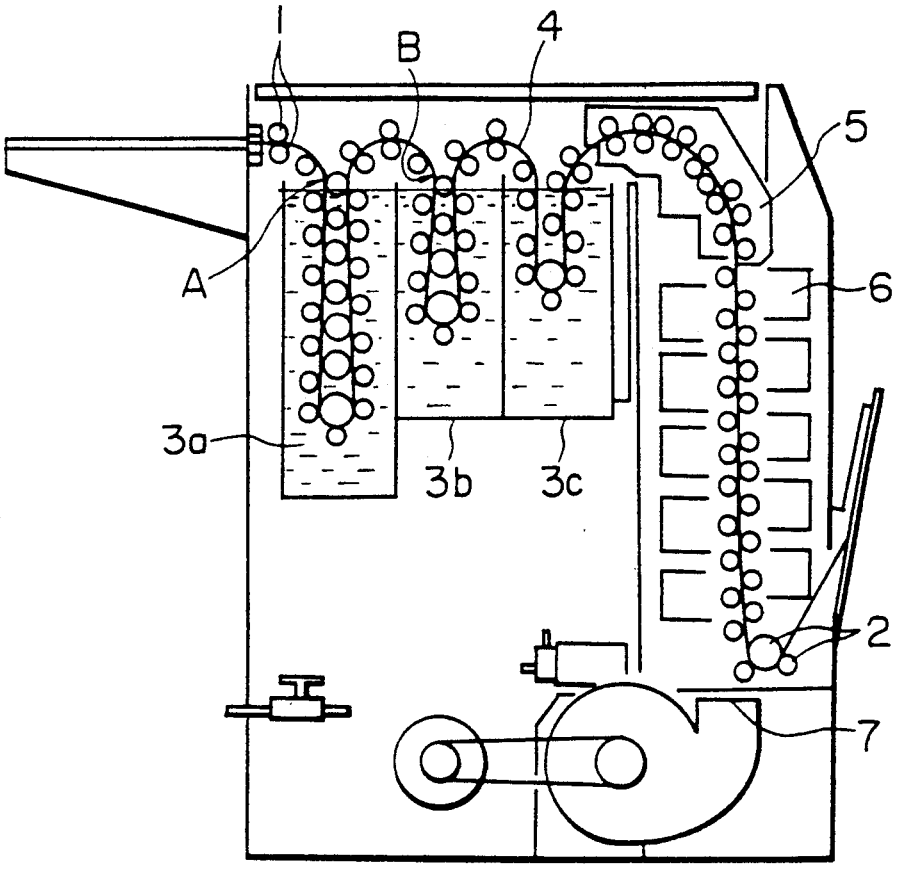
FIGS. 1 and 2 are schematic views which each illustrate the constitution of an automatic processor experimentally manufactured for use in the Examples.

The developing solution used in the present invention may preferably be adjusted to have a pH value of not less than 10.17 at 35° C. This pH condition enables better prevention of development non-uniformity. The pH may more preferably be from 10.20 to 10.45. Adjusting the pH to be not more than 10.45 makes it possible to keep a good oxidation resistance of the developing solution.

The developing solution used in the present invention will be described in detail. The present developing solution contains hydroquinone, 1-phenyl-4-methyl-3-pyrazolidone, and 1-phenyl-4,4-dimethyl-3-pyrazolidone or 1-phenyl-4-methyl-4-hydroxymethyl-3-pyrazolidone. The present developing solution may also contain both 1-phenyl-4,4-dimethyl-3-pyrazolidone and 1-phenyl-4-methyl-4-hydroxymethyl-3-pyrazolidone.

There are no particular limitations on the amount of the above compounds in the developing solution of the present invention. In general, hydroquinone may preferably be used in an amount, per liter of the developing solution, of from 22 to 38 g; 1-phenyl-4-methyl-3-pyrazolidone, from 0.1 to 4.0 g; and 1-phenyl-4,4-dimethyl-3-pyrazolidone or 1-phenyl-4-methyl-4-hydroxymethyl-3-pyrazolidone, from 0.1 to 4.0 g.

The developing solution according to the present invention may contain various substances that function as preservatives, as exemplified by sulfites, carbonates, borates, and other appropriate compounds.

The sulfites may preferably be added in an amount of not less than 29 g ion in terms of sulfite ion, per liter of the developing solution used.

The developing solution according to the present invention may also contain an alkali agent as exemplified by potassium hydroxide, sodium hydroxide, and other compounds.

As previously described, the developing solution used may preferably have a pH value of not less than 10.17 (35° C.). Such pH can be adjusted by the use of the alkali agents described above.

The developing solution according to the present invention may further contain glutaraldehyde. The glutaraldehyde may preferably be contained in an amount ranging from 0 to 5 g per liter of the developing solution used.

In working the present invention, the developing solution may be formed by mixing with water a solution prepared as a concentrated developing solution, which is used as a working solution. The fixing solution may also be formed by mixing a concentrated fixing solution with water, which is used as a working solution (see Example 2 disclosed in Japanese Patent Publication Open to Public Inspection (hereinafter referred to as Japanese Patent O.P.I. Publication) No. 305343/1988). There are no particular limitations on light-sensitive materials to be processed to which the processing method of the present invention is applied. All sorts of light-sensitive materials can be processed by the method of the present invention.

In general, light-sensitive silver halide photographic materials are so constituted as to comprise a substrate and at least one light-sensitive silver halide emulsion layer provided on at least one side of the support. Among such light-sensitive materials, the present invention can be particularly effectively applied to those in which the weight of silver is not more than 3.5 g/m$^2$ per one side of the support. The present invention can also be effectively applied to those in which the weight of a hydrophilic colloid is not more than 4.5 g/m$^2$ per one side of the support. More preferably it can be effective for those in which the weight of a hydrophilic colloid is not more than 4.0 g/m$^2$ per one side of the support. It can also be advantageously applied to those which meet the condition that the time by which gelatin begins to dissolve when immersed in an aqueous solution of 1.5% by weight of sodium hydroxide at 60° C. is not less than 3 minutes, and preferably not less than 4 minutes and not more than 60 minutes.

The present invention can also preferably be applied to light-sensitive silver halide photographic materials in which a photographic component layer on the side having a light-sensitive silver halide has:

(i) a total hydrophilic colloid weight of from 2.0 to 3.8 g/m$^2$;

(ii) a silver halide weight of less than 3.5 g/m$^2$ in terms of silver weight; and (iii) its dissolution point of not less than 86° C. in water. The dissolution point refers to a value measured in water having a specific resistance of not less than $1\times10^6$ Ω.cm. The dissolution point can be controlled to be not less than 86° C. using, for example, a gelatin hardener.

Except the above, the light-sensitive material to be processed may have any silver halide composition, any grain constitution, any layer constitution and any additives used.

In Expression I, l represents a line length (m) through which a light-sensitive material firstly comes into contact with the surface of a developing solution and thereafter comes into contact with the surface of a fixing solution.

Figure 2:
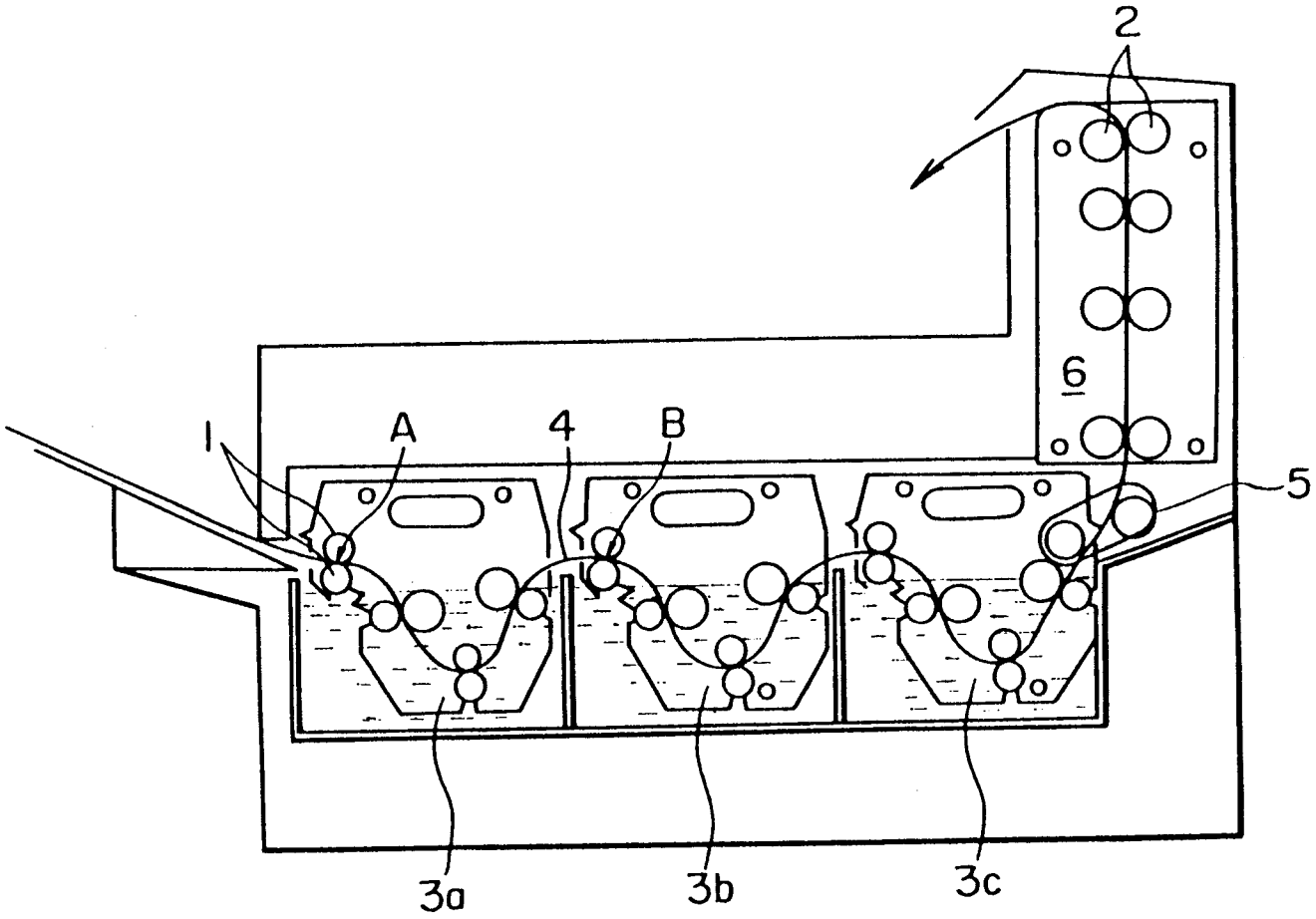

For example, FIGS. 1 and 2 exemplify automatic processors experimentally manufactured. In FIGS. 1 and 2, 3*a* denotes a developing tank, 3*b*, a fixing tank and 3*c*, a washing tank. Referring to these examples, the letter symbol A in the drawings denotes the postion at which a light-sensitive material 4 directed by inlet rollers 1 starts to come into contact with a developing solution, and B, the position at which it comes into contact with a fixing solution. Hence, the l in the examples shown in the drawings corresponds to the processing line length between A and B in the drawings.

In the present invention, l is not more than 0.6 m. In the experimentally manufactured automatic processors as illustrated in FIGS. 1 and 2, l is 0.58 m or 0.28 m, respectively.

In Expression I, T represents a time (second) required for the light-sensitive material processed to pass said l. The shorter this time is, the shorter the processing time can be made, in general.

In working the present invention, in general, a larger number of total delivery rollers of an automatic processor used brings about a greater development activity, giving a higher sensitivity. The number of the rollers may preferably be such that a value obtained by dividing the above l by the number of rollers is in the range of from 0.02 to 0.12. The time required for each processing section may preferably be in the following range.

| | |
|---|---|
| Insertion + developing + cross-over | 25 to 40% |
| Fixing + cross-over | 12 to 25% |
| Washing + cross-over | 10 to 25% |
| Squeezing + drying | 25 to 45% |
| Total | 100% |

Rollers used may preferably range between 12 mm and 60 mm in diameter at the delivery portion, and between 30 cm and 110 cm in length. Rollers made of various materials can be used. For example, those of a Bakelite type (which may contain glass powder, metal powder or plastic powder) and those of a rubber type (such as Neoprene, isoprene or silicone rubber) can be used at the developing, fixing, washing and drying sections. At the cross-over guides or squeezing sections, it is preferred to use silicone rubbers having water repellency and resiliency, or synthetic leathers "Kurarino" (trade name; available from Kuraray).

In order to improve transport performance, the delivery rollers may be provided with irregularities, for example, irregularities with valley depths preferably ranging from 0.05 to 1.0 mm.

In order to reduce the drying load at the drying section 6, it is also preferred for the film to have a water content so controlled as to be not more than 20 g/m$^2$ until it reaches a squeezing rack. For example, it can be effective to use the above water-repellent rollers, or, in reverse, to use rollers with a large water absorption. It is also good to design the processor so that part of the drying air may be circulated to squeezing rollers.

Outlet rollers 2 are disposed downstream of the drying section 6.

At the drying section, it is preferred to control the distance from an air outlet of the drying air to the film so as to range from 1 to 10 mm so that the light-sensitive material can be well dried, for example, the heat conduction coefficient can be made larger. The temperature of the drying air delivered by blower 7 may preferably be in the range of from 35° to 55° C. An infrared heater or microwave drying may also be used in combination at the same time.

EXAMPLES

Examples of the present invention will be described below.

EXAMPLE 1

Using as nuclei, monodisperse silver iodobromide grains having an average grain size of 0.2 μm and containing 2.0 mol % of silver iodide, grains of silver iodobromide containing 30 mol % of silver iodide were grown under conditions of pH 9.1 and pAg 7.7. Thereafter, potassium bromide and silver nitrate were added in equimolar amounts under conditions of pH 8.0 and pAg 9.1. A monodisperse emulsion with an average grain size of 1.02 μm, 0.58 μm or 0.45 μm, comprising silver iodobromide grains containing 2.1 mol of silver iodide on the average, was thus prepared. The emulsion was desalted by a conventional coagulation method to remove excess salts. More specifically, the emulsion was kept at 40° C., and a formalin condensate of sodium naphthalene sulfonate and an aqueous solution of magnesium sulfate were added in the emulsion to effect coagulation. After removal of the supernatant, pure water was added until the emulsion came to have a temperature of 40° C. was further added, and an aqueous solution of magnesium sulfate was again added to effect coagulation, followed by removal of the supernatant. The resulting grains corresponding to the above three types of emulsions were each subjected to chemical ripening by adding ammonium thiocyanate in an amount of $1.9\times10^{-3}$ mol per mol of silver, chloroauric acid and sodium thiosulfate in appropriate amounts, and the following spectral sensitizers A and B in a weight ratio of 200:1 in their total amounts of 400 mg in respect of the grains with an average grain size of 1.02 μm, 650 mg in respect of the grains of 0.58 μm, and 800 mg in respect of the grains of 0.45 μm, all per mol of silver halide. Then, 15 minutes before completion of the chemical ripening, potassium iodide was added in each emulsion in an amount of 200 mg per mol of silver. Thereafter, the three types of emulsions were stabilized using $3\times10^{-2}$ mol of 4-hydroxy-6-methyl-1,3,3a,7-tetrazaindene, and mixed in molar ratios of 15%, 60% and 25%, respectively, in the order of emulsion grains with a larger size, to which the additives as will be described later and lime-treated gelatin were added. An emulsion-coating solution (1) was thus prepared.

An emulsion-coating solution (2) as described below was also prepared.

In 1 l of water, 30 g of gelatin, 10.5 g of potassium bromide and 10 ml of an aqueous 0.5 wt. % solution of a thioether $[HO(CH_2)_2S(CH_2)_2S(CH_2)_2S(CH_2)_2OH]$ were added and dissolved. In the resulting solution, kept at 63° C. (pAg=9.1, pH=6.5), 30 ml of an aqueous 0.88 mol silver nitrate solution and 30 ml of an aqueous 0.88 mol mixed solution of potassium iodide and potassium bromide (molar ratio: 97:3) were simultaneously added in 15 seconds with stirring. Thereafter, 600 ml of an aqueous 1 mol silver nitrate solution and 600 ml of an aqueous 1 mol mixed solution comprising potassium bromide and potassium iodide with a molar ratio of 96.5:3.5 were added over a period of 70 minutes. A tabular silver iodobromide emulsion was thus prepared. The tabular silver iodobromide emulsion obtained had an average grain size of 1.15 μm, a thickness of 0.10 μm, and a silver iodide content of 3.0 mol %. This emulsion was desalted by precipitation, and then chemically sensitized using gold sensitization and sulfur sensitization in combination. Thereafter, a sensitizing dye, sodium 3-{5-chloro-2-(2-[5-chloro-3-(3-sulfonatopropyl)benzoxyazolin-2-idenemethyl]-1-butene)-3-benzoxazolio}propanesulfonate, was added in an amount of 160 mg per mol of silver halide, followed by further addition of 4-hydroxy-6-methyl-1,3,3a,7-tetrazaindene in the same manner as in the above.

The grains were chemically sensitized to the optimum by the same method as in the above, and the same stabilizer, additives and lime-treated gelatin as in the above were added. An emulsion-coating solution (2) was thus prepared.

In the coating solution, the following compounds (1) and (2) were added in the following amounts per mol of silver halide, in addition to the additives as described later.

(1) 200 mg

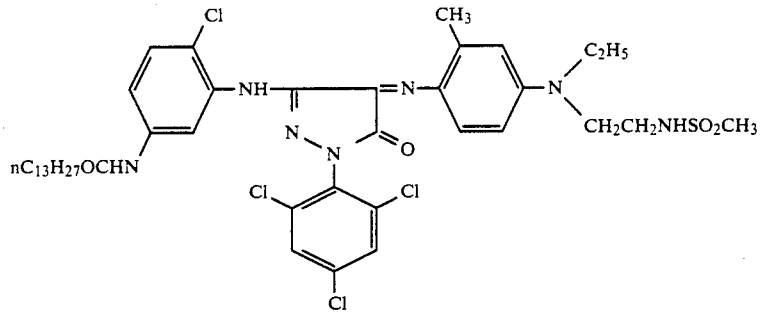

(2) Tricresyl phosphate 0.6 g

More specifically, the compound (1) was dissolved in the compound (2), which was then dispersed in a hydrophilic colloid solution, and the resulting dispersion was added so as to give the above amounts.

A protective layer solution was prepared to have the composition as described later.

Using the above solutions, the coating solutions were simultaneously coated on both sides of a 175 μm thick polyethylene terephthalate film at a speed of 60 m per minute using two sets of slide hopper coaters, so as to be 2.0 g/m² in terms of silver and 2.0 g/m² as hydrophilic colloid coating weight on the emulsion side, and so as to be 1.0 g/m² as gelatin coating weight on the protective layer, followed by drying for 2 minutes and 15 seconds.

The polyethylene terephthalate film was previously coated as a subbing solution with an aqueous copolymer dispersion obtained by diluting to a concentration of 10 wt. % a copolymer comprising three kinds of monomers of 50 wt. % of glycidyl methacrylate, 10 wt. % of methyl acrylate and 40 wt. % of butyl methacrylate. Samples 1 and 2 for which the emulsion-coating solutions (1) and (2), respectively, were used, were thus obtained.

Spectral sensitizers used in the preparation of the samples are as follows:

Spectral sensitizer A

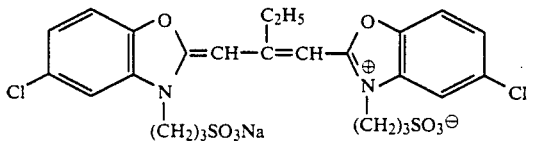

Spectral sensitizer B

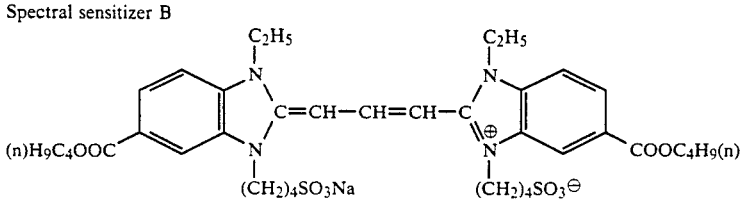

Additives used in the emulsion solution (light-sensitive silver halide coating solution) are as follows. The amounts for their addition are expressed in terms of weight per mol of silver halide.

| | |
|---|---|
| 1,1-Dimethylol-1-bromo-1-nitromethane | 70 mg |
| 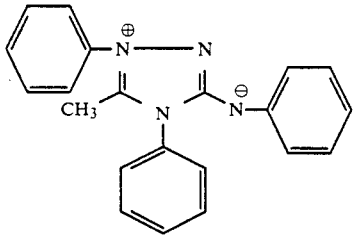 | 150 mg |
| t-Butyl-catechol | 400 mg |
| Polyvinyl pyrrolidone (molecular weight: 10,000) | 1.0 g |
| Styrene/maleic anhydride copolymer | 2.5 g |
| Trimethtlol propane | 10 g |
| Diethylene glycol | 5 g |
| Nitrophenyl-triphenyl phosphonium chloride | 50 mg |
| Ammonium 1,3-dihydroxybenzene-4-sulfonate | 4 g |
| Sodium 2-mercaptobenzimidazole-5-sulfonate | 1.5 mg |
| 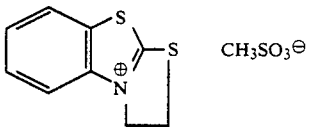 | 70 mg |
| $n\text{-}C_4H_9OCH_2CH(OH)CH_2N(CH_2COOH)_2$ | 1 g |

Additives used in the protective layer solution are as follows. The amounts for their addition are expressed in terms of weight per liter of the coating solution.

| | |
|---|---|
| Lime-treated gelatin | 68 g |
| Acid-treated gelatin | 2 g |
| $NaO_3S-CH(CH_2COOC_{10}H_{21})-COOC_5H_{11}$ (coating aid) | 1 g |
| Polymethyl methacrylate, a matting agent with an area average particle diameter of 3.5 μm | 1.1 g |
| Silicon dioxide particles, a matting agent with an area average particle diameter of 1.2 μm | 0.5 g |
| Ludox AM (a product of DuPont Co.) (colloidal silica) | 30 g |
| Aqueous 2% solution of 2,4-dichloro-6-hydroxy-1,3,5-triazine sodium salt (a hardening agent) | 10 ml |
| Formalin 35% (a hardening agent) | 2 ml |
| Aqueous 40% glyoxal solution (a hardening agent) | 1.5 ml |
| 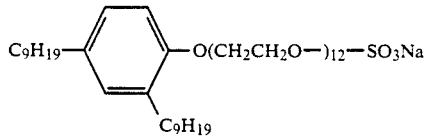 | 1.0 g |
| 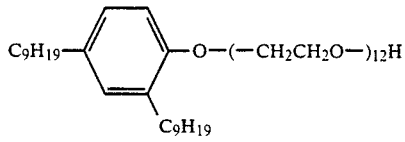 | 0.4 g |
| $CH_2COO(CH_2)_9CH_3$ / $CHCOO(CH_2)_2CH(CH_3)_2$ / $SO_3Na$ | 0.3 g |
| 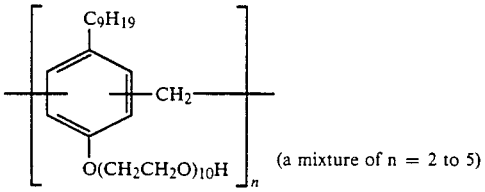 (a mixture of n = 2 to 5) | 2.5 g |
| $NaO_3S-CH(CH_2COOCH_2(C_2F_4)_3H)-COOCH_2(C_2F_4)_3H$ | 0.5 g |
| $F_{19}C_9-O-(-CH_2CH_2O-)_{10}-CH_2CH_2-OH$ | 33 mg |
| $C_4F_9SO_3K$ | 22 mg |

Processing was carried out using an automatic processor SRX-501 (l=0.616 m, manufactured by Konica Corporation) and the experimentally manufactured automatic processors as illustrated in FIGS. 1 and 2. The processing time was varied as shown in Table 1 by controlling drive motor control sections of the SRX-501 processor and both the experimentally manufactured automatic processors.

Using the following (a), (b), (a)—a to (a)-c and (b)-a to (b)-c as developing solutions, the developing solution as shown in Table 1 was put in the automatic processor as shown in Table 1 for each processing. Processing was thus carried out. Fixing was carried out at 33° C. using a fixing solution XF-SR (a product of Konica Corporation). Washing was carried out using well water of 18° C. The washing water was supplied in a quantity of 1.8 l per minute in respect of the SRX-501 processor and the automatic processor illustrated in FIG. 1, and in a quantity of 60 ml per 10×12 inch size sheet in respect of the automatic processor illustrated in FIG. 2.

| Developing solution (a): | |
|---|---|
| Potassium sulfite | 70 g |
| Trisodium hydroxyethyl ethylenediaminetriacetic acid | 8 g |
| Hydroquinone | 28 g |
| Boric acid | 10 g |
| 5-Methylbenzotriazole | 0.04 g |
| 1-Phenyl-5-mercaptotetrazole | 0.01 g |
| Sodium metabisulfite | 5 g |
| Acetic acid (an aqueous 90% solution) | 13 g |
| Triethylene glycol | 15 g |
| 1-Phenyl-4-methyl-3-pyrazolidone | 1.2 g |
| 5-Nitroindazole | 0.2 g |
| 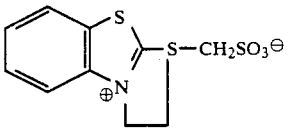 | 0.001 g |
| Glutaraldehyde | 4.0 g |
| Disodium ethylenediaminetetraacetic acid | 2.0 g |
| Potassium bromide | 4.0 g |
| 5-Nitrobenzoimidazole | 1.0 g |

Made up to an aqueous solution of 1 l, and adjusted to pH 10.50 with potassium hydroxide. In the developing tank, as a starter, 8 ml of a starter containing 1.8 g of acetic acid and 2 g of potassium bromide was added to adjust the pH to 10.15.

| Developing solution (b): | |
|---|---|
| Concentrated developing solution | |
| Potassium hydroxide | 56.6 g |
| Sodium sulfite | 200 g |
| Diethylenetriaminepentaacetic acid | 6.7 g |
| Potassium carbonate | 16.7 g |
| Boric acid | 10 g |
| Hydroquinone | 83.3 g |
| Diethylene glycol | 40 g |
| 1-Phenyl-4-methyl-4-hydroxymethyl-3-pyrazolidone | 11.0 g |
| 5-Methylbenzotriazole | 2 g |

Made up to 1 l using water. The pH was adjusted to 10.60.

When the developing is started, the developing tank is filled with the following processing solution.

(Processing Solution)

The above concentrated developing solution (333 ml), 667 ml of water, and 10 ml of a starter containing 2 g of potassium bromide and 1.8 g of acetic acid were added to adjust the pH to 10.15.

Developing solution (a)—a

A solution comprising the developing solution (a) to which 1-phenyl-4,4-dimethyl-3-pyrazolidone was added in an amount of 1.5 g per liter of the solution.

Developing solution (a)-b

A solution comprising the developing solution (a) to which potassium hydroxide was added so that the pH was adjusted to 10.63 when the solution was made up with $H_2O$, and to which a starter was added to adjust the pH in the developing tank to 10.18.

Developing solution (a)-c

A solution comprising the developing solution (a)-b to which 1-phenyl-4,4-dimethyl-3-pyrazolidone was added in an amount of 1.5 g per liter of the solution.

Developing solution (b)-a

A solution comprising the developing solution (b) to which 1-phenyl-4-methyl-3-pyrazolidone was added in an amount of 0.8 g per liter of the solution.

Developing solution (b)—b

A solution comprising the developing solution (b) to which potassium hydroxide was added so that the pH was adjusted to 10.19 when the solution was made up with $H_2O$, and to which a starter was added to adjust the pH in the developing tank to 10.20.

Developing solution (b)-c

A solution comprising the developing solution (b)—b to which 1-phenyl-4-methyl-3-pyrazolidone was added in an amount of 0.8 g per liter of the solution.

In each processing;

the developing solution was supplied in a quantity of 28 ml per 10×12 inch size sheet; and the fixing solution, in a quantity of 48 ml per 10×12 inch size sheet. The developing was carried out at a temperature of 34° C. in all instances.

On the image obtained as a result of each processing, the development non-uniformity was evaluated to obtain the results as shown in Table 1.

The evaluation on development non-uniformity, the results of which are as shown in Table 1, was made in the following way: The samples were each inserted between fluorescent intensifying screens KO-250 (available from Konica Corporation), which was then irradiated with X-rays at a tube voltage of 90 kVP, and exposure was carried out so as to give a density in the range of from 1.0 to 1.2 after development. Films were all in a 10×12 inch size, 10 sheets of which were continuously processed, and the development non-uniformity was visually evaluated on the 10th sheet.

Evaluation criterions

A: No development non-uniformity is seen.

B: Development non-uniformity occurs in an area of not more than 10%.

C: Development non-uniformity occurs in an area of not more than 30%.

D: Development non-uniformity occurs in an area of not more than 50%.

E: Development non-uniformity occurs in an area of more than 50%.

TABLE 1

| Processing No. | Developing solution | Automatic processor | T* (sec) | $l^{0.75}$xT (msec) | Processing non-uniformity Sample 1 | Processing non-uniformity Sample 2 | Remarks |
|---|---|---|---|---|---|---|---|
| 1 | (a) | SRX-501 | 15.5 | 10.8 | A | A | X |
| 2 | (b) | SRX-501 | 15.5 | 10.8 | A | A | X |
| 3 | (a) | SRX-501 | 14.4 | 10.0 | B | B | X |
| 4 | (b) | SRX-501 | 14.4 | 10.0 | A | B | X |
| 5 | (a) | FIG. 1 | 16.1 | 10.7 | A | A | X |
| 6 | (a) | FIG. 1 | 14.7 | 9.8 | D | E | X |
| 7 | (a) | FIG. 1 | 12.9 | 8.6 | E | E | X |
| 8 | (a)-a | FIG. 1 | 14.7 | 9.8 | A | B | Y |
| 9 | (a)-a | FIG. 1 | 12.9 | 8.6 | B | B | Y |
| 10 | (a)-b | FIG. 1 | 12.9 | 8.6 | D | E | X |
| 11 | (a)-c | FIG. 1 | 12.9 | 8.6 | A | A | Y |
| 12 | (b) | FIG. 1 | 16.1 | 10.7 | A | A | X |
| 13 | (b) | FIG. 1 | 14.7 | 9.8 | C | D | X |
| 14 | (b) | FIG. 1 | 12.9 | 8.6 | E | E | X |
| 15 | (b)-a | FIG. 1 | 14.7 | 9.8 | A | A | Y |
| 16 | (b)-a | FIG. 1 | 12.9 | 8.6 | B | B | Y |
| 17 | (b)-b | FIG. 1 | 12.9 | 8.6 | D | D | X |
| 18 | (b)-c | FIG. 1 | 12.9 | 8.6 | A | A | Y |
| 19 | (a) | FIG. 2 | 28.0 | 10.8 | B | B | X |
| 20 | (b) | FIG. 2 | 28.0 | 10.8 | B | B | X |
| 21 | (a) | FIG. 2 | 26.0 | 10.0 | D | D | X |
| 22 | (a) | FIG. 2 | 24.0 | 9.2 | E | E | X |
| 23 | (a)-a | FIG. 2 | 24.0 | 9.2 | B | B | Y |
| 24 | (a)-b | FIG. 2 | 24.0 | 9.2 | D | D | X |
| 25 | (a)-c | FIG. 2 | 24.0 | 9.2 | A | A | Y |
| 26 | (b) | FIG. 2 | 24.0 | 9.2 | E | E | X |
| 27 | (b)-a | FIG. 2 | 24.0 | 9.2 | B | B | Y |
| 28 | (b)-b | FIG. 2 | 24.0 | 9.2 | D | E | X |
| 29 | (b)-c | FIG. 2 | 24.0 | 9.2 | A | A | Y |
| 30 | (b)-c | FIG. 2 | 21.0 | 8.1 | B | B | Y |

*Time required for the light-sensitive material to pass the l.
X: Comparative Example;
Y: Present Invention As Table 1 shows, it is seen that remarkable development non-uniformity tends to occur in the instance where the processing falling under Expression I is carried out using a comparative developing solution, i.e., in the instance where an automatic processor (the one as illustrated in FIG. 1 or 2) in which $l^{0.75} \times T < 10.5$ and l is not more than 0.6 is used.

On the other hand, in the processing according to the present invention, carried out using as a developing solution the developing solution in which hydroquinone, 1-phenyl-4-methyl-3-pyrazolidone, and also 1-phenyl-4,4-dimethyl-3-pyrazolidone or 1-phenyl-4-hydroxymethyl-3-pyrazolidone are used in combination, the development non-uniformity in the processing falling under Expression I is greatly prevented. In the processing in which the pH is made higher, the development non-uniformity is further effectively prevented.

In comparison between Samples 1 and 2, it is seen that Sample 2, in which the tabular silver halide grains are used, to a greater extent prevents the development non-uniformity by the application of the present invention.

As described in the above, the present invention brings about the effect that the method is feasible for rapid processing, may cause less development non-uniformity even when rapid processing is carried out, and can exhibit such effect even when the above l is not more than 0.6 m, and hence can also make reduce the scale of an automatic processor.

What is claimed is:

1. A method of processing an exposed silver halide photographic material comprising bringing said material into contact with (a) a developing solution comprising hydroquinone, 1-phenyl-4-methyl-3-pyrazolidone and 1-phenyl-4,4-dimethyl-3-pyrazolidone or 1-phenyl-4-methyl-4-hydroxy-methyl-3-pyrazolidone and (b) a fixing solution in an automatic processor having a line length l through which the material first comes into contact with a surface of the developing solution and thereafter comes into contact with a surface of the fixing solution, wherein l measured in meters is <0.6 and wherein l satisfies the formula $$l^{0.75} \times T < 10.5$$

wherein T is a time measured in seconds required for the material to pass the length l.

2. The method as claimed in claim 1, wherein the developing solution comprises hydroquinone, 1-phenyl-4-methyl-3-pyrazolidone and 1-phenyl-4,4-dimethyl-3-pyrazolidone.

3. The method as claimed in claim 1, wherein the developing solution comprises hydroquinone, 1-phenyl-4-methyl-3-pyrazolidone and 1-phenyl-4-methyl-4-hydroxymethyl-3-pyrazolidone.

4. The method as claimed in claim 1, wherein the developing solution further comprises a sulfite compound.

5. The method as claimed in claim 1, wherein the developing solution further comprises a glutaraldehyde.

6. The method as claimed in claim 1 wherein the developing solution has a pH value of 10.20 to 10.45 at 35° C.

7. The method as claimed in claim 1, wherein the developing solution comprises hydroquinone in an amount of 22 to 38 g/l.

8. The method as claimed in claim 1, wherein the developing solution comprises 1-phenyl-4-methyl-3-pyrazolidone in an amount of 0.1 to 4.0 g/l.

9. The method as claimed in claim 1, wherein the developing solution comprises 1-phenyl-4-methyl-4-hydroxymethyl-3-pyrazolidone in an amount of 0.1 to 4.0 g/l.

10. The method as claimed in claim 1, wherein the developing solution has a pH value of not less than 10.17 at 35° C.

11. The method as claimed in claim 10, wherein the developing solution further comprises a sulfite compound and glutaraldehyde and said sulfite compound is in an amount of not less than 29 g ion in terms of sulfite ion per liter of developing solution and said glutaraldehyde is in an amount of up to 5 g per liter of developing solution.

12. The method as claimed in claim 1, wherein the silver halide photographic material comprises a support and at least one light-sensitive silver halide emulsion layer provided on at least one side of the support and wherein silver is in an amount of not more than 3.5 g/m$^2$ per one side of the support.

13. The method as claimed in claim 12, wherein the photographic material further comprises a hydrophilic colloid and the colloid is in an amount of not more than 4.5 g/m$^2$ per one side of the support.

14. The method as claimed in claim 1, wherein a plurality of delivery rollers in the automatic processor contact the photographic material to transport the material through the developing solution and the fixing solution, wherein the number of rollers is determined by the formula l/0.02 to 0.12.

15. The method according to claim 1, which further comprises subjecting the material to washing, squeegeeing and drying after contact with the fixing solution.

16. The method as claimed in claim 15, wherein the material passes through the following processing stations in the following order:

(i) insertion and developing and cross-over, (ii) fixing and cross-over, (iii) washing and cross-over and (iv) squeezing and drying and the proportion of the total time for each of the stations (i) to (iv) is as follows.

(i) : 25 to 40%, (ii) : 12 to 25%

(iii) : 10 to 25% and (iv) : 25 to 45%.

17. The method according to claim 16, wherein said drying is conducted by contacting the material with a hot air source to produce a hot air at a temperature of 35° to 55° C. and the material is maintained at a distance of 1 to 10 mm from the outlet of the hot air source.

18. The method as claimed in claim 14, wherein the delivery rollers have a diameter of 12 mm to 60 mm and are provided with irregularities with valley depths of 0.05 to 1 mm.

* * * * *